US007583033B2

(12) United States Patent
Ikeda

(10) Patent No.: US 7,583,033 B2
(45) Date of Patent: Sep. 1, 2009

(54) PLASMA DISPLAY PANEL DRIVING CIRCUIT AND PLASMA DISPLAY APPARATUS

(75) Inventor: Satoshi Ikeda, Osaka (JP)

(73) Assignee: Panasonic Corporation, Osaka (JP)

( * ) Notice: Subject to any disclaimer, the term of this patent is extended or adjusted under 35 U.S.C. 154(b) by 170 days.

(21) Appl. No.: 11/671,154

(22) Filed: Feb. 5, 2007

(65) Prior Publication Data

US 2007/0195051 A1 Aug. 23, 2007

(30) Foreign Application Priority Data

Feb. 6, 2006 (JP) ..... 2006-028063

(51) Int. Cl.
*G09G 3/10* (2006.01)
*G09G 3/28* (2006.01)

(52) U.S. Cl. ..... 315/169.3; 345/68

(58) Field of Classification Search ..... 315/169.3, 315/169.4; 345/60, 62, 63, 66, 68, 53–54
See application file for complete search history.

(56) References Cited

U.S. PATENT DOCUMENTS 6,781,322 B2 * 8/2004 Onozawa et al. ..... 315/169.3
6,906,690 B2 * 6/2005 Lim ..... 345/60
7,006,057 B2 * 2/2006 Jin et al. ..... 345/60
7,068,245 B2 * 6/2006 Nagao et al. ..... 345/60
7,268,749 B2 * 9/2007 Marcotte et al. ..... 345/60
2005/0110709 A1 * 5/2005 Lee ..... 345/60
2006/0038750 A1 2/2006 Inoue et al. ..... 345/60

FOREIGN PATENT DOCUMENTS

JP 2005-070598 3/2005

OTHER PUBLICATIONS

English Language Abstract of JP 2005-070598.

* cited by examiner

*Primary Examiner*—Douglas W Owens
*Assistant Examiner*—Minh D A
(74) *Attorney, Agent, or Firm*—Greenblum & Bernstein, P.L.C.

(57) ABSTRACT

A plasma display panel driving circuit for driving a plasma display panel which has a plurality of scan electrodes and sustain electrodes and operates as a capacitive load, by applying a different waveform in each of a reset period, address period and sustain period, includes a voltage multiplying circuit having a first input terminal to which 0 or a first voltage is inputted and a second input terminal to which a second voltage that is smaller than the first voltage is inputted. The voltage multiplying circuit is operable to generate a voltage prepared by adding the second voltage to a voltage equivalent to integral multiple of the first voltage.

8 Claims, 8 Drawing Sheets

PLASMA DISPLAY PANEL DRIVING CIRCUIT AND PLASMA DISPLAY APPARATUS

BACKGROUND ART

1. Field of the Invention

The present invention relates to a plasma display panel driving circuit and a plasma display apparatus used for wall-mounted televisions and large-size monitors.

2. Related Art

An AC drive surface discharge type panel, typically represented by a plasma display panel (hereinafter, abbreviated as "PDP"), has a structure in which a number of discharge cells are formed between a front face plate and a back face plate that are disposed face to face with each other. On the front face plate, a plurality of pairs of display electrodes, each pair constituted by a scan electrode and a sustain electrode, are formed on a front face glass substrate in parallel with each other, and a dielectric layer and a protective layer are formed in a manner so as to cover the paired display electrodes. On the back face plate, a plurality of data electrodes that are in parallel with each other are formed on a back face glass substrate, and a dielectric layer that covers these is formed, and a plurality of partition walls are further formed thereon in parallel with the data electrodes, with phosphor layers being formed on the surface of the dielectric layer and the side faces of each partition wall. Moreover, the front face plate and the back face plate are disposed face to face with each other, and tightly sealed in such a manner that the paired display electrodes and the data electrodes intersect with each other three dimensionally. The inner discharge space is filled with a discharge gas containing xenon. Here, a discharge cell is formed at a portion at which the paired display electrodes and data electrode are made face to face with each other is formed.

In the panel having this structure, ultraviolet rays are generated by a gas discharge in each discharge cell, and the phosphors of the respective colors of red (R), green (G) and blue (B) are excited by the ultraviolet rays to emit light rays so that a color displaying process is carried out. Moreover, the panel carries out gray-scale displaying processes through a sub-field method, that is, processes in which one field period is divided into a plurality of sub-fields and gray-scale display is achieved based upon combinations of sub-fields to be emitted. Each sub-field have a reset period, an address period and a sustain period. During the reset period, a reset discharge is generated to generate a wall charge required for the succeeding address operation on each electrode. During the address period, an address discharge is generated selectively in the discharge cell to be emitted, in order to form a wall charge. Moreover, during the sustain period, a sustain pulse is alternately applied to a scan electrode and a sustain electrode which compose a display electrode pair so that a sustain discharge is caused in the discharge cell in which the address discharge is caused. Thus, the phosphor layer of the corresponding discharge cell emits light, and an image displaying process is carried out. In this manner, in order to display image data, respectively different signal waveforms are applied to the respective electrodes depending on the reset period, the address period and the sustain period.

Since driving voltage waveforms that are different for the respective periods in the sub-field and the respective electrodes are generated, a plasma display apparatus having such a panel has a driving circuit including a plurality of constant voltage power supplies having different output voltages and a number of parts such as switching elements and capacitors. There have been strong demands for simplifying the structure of such a driving circuit.

For simplifying the structure of the driving circuit, the following technique has been proposed. That is, a voltage doubler circuit which can output a voltage of integral multiple of a reference voltage is provided in the driving circuit, and also switching elements included in the voltage doubler circuit are compatibly used as other switching elements prepared for controlling the application of a driving pulse voltage to the electrodes (for example, see JP-A-2005-70598).

FIG. 8 is a circuit diagram of the driving circuit described in the above-mentioned prior art. The driving circuit includes a constant voltage generating circuit including a sustain pulse generating circuit, a reset waveform generating circuit and a voltage doubler. In the constant voltage generating circuit, the voltage doubler circuit generates a voltage of integral multiple of a voltage of a constant voltage power supply included in the sustain pulse generating circuit, and a regulator 55 converts the voltage to a voltage required for the reset waveform generating circuit to output the converted voltage. With this arrangement, it becomes possible to omit the constant voltage power supply in the reset waveform generating circuit.

It is a rare case that in a plasma display apparatus, regarding a constant voltage power supply used for a certain driving circuit, another constant voltage power supply having a voltage of integral multiple of the voltage of the constant voltage power supply is used for another driving circuit. For example, the voltage of a constant voltage power supply to be used in a reset waveform generating circuit that generates a reset waveform in the reset period is normally set to about 2.5 times the voltage (Vs) of the constant voltage power supply to be used in a sustain pulse generating circuit for generating a sustain pulse during the sustain period. For example, in the example of FIG. 8, a voltage of 2 Vs is generated from a voltage of Vs by a voltage multiplying circuit 56, and a voltage of 1.5 Vs is generated from the voltage of 2 Vs by a regulator 55, and thereafter, a voltage of 2.5 Vs is generated by a diode D5 and a capacitor C3.

Therefore, in the above-mentioned prior art, it is not possible to take a desired voltage of decimal multiple of the reference voltage only by the voltage doubler circuit which can output a voltage of integral multiple of the reference voltage. Thus it is necessary to generate once a voltage which is higher than a desired voltage and is a voltage of integral multiple of the reference voltage by the voltage doubler circuit and convert the generated voltage to be the desired voltage (voltage of decimal multiple) by the regulator. Therefore, even when the constant voltage power supply can be omitted, a regulator is required together with a voltage doubler, and thus it is not possible to sufficiently reduce the number of elements composing the driving circuit.

SUMMARY OF THE INVENTION

The present invention has been devised so as to solve the above-mentioned problems, and has its purpose to provide a PDP driving circuit which can generate a voltage required for driving the panel using only a voltage multiplying circuit, with the number of elements composing the driving circuit being reduced, and a plasma display apparatus using such a driving circuit.

A plasma display panel driving circuit of the present invention is a driving circuit for driving a plasma display panel which has a plurality of scan electrodes and sustain electrodes and operates as a capacitive load, by applying a different waveform in each of a reset period, address period and sustain period. The plasma display panel driving circuit includes a voltage multiplying circuit having a first input terminal to which 0 or a first voltage is inputted and a second input terminal to which a second voltage that is smaller than the first voltage is inputted. The voltage multiplying circuit is operable to generate a voltage prepared by adding the second voltage to a voltage equivalent to integral multiple of the first voltage. With this arrangement, it is possible to generate a voltage equivalent to a decimal multiple of the first voltage using only the voltage multiplying circuit. Consequently a voltage required for driving can be generated without a regulator.

The plasma display panel driving circuit may further include a sustain pulse generating circuit which is a circuit including a dc power supply and generating a voltage waveform to be applied to the scan electrodes during the sustain period based upon the output voltage of the dc power supply. The sustain pulse generating circuit includes a power recovery section that recovers power accumulated in the capacitive load into a recovery capacitor by LC resonance and reuses the recovered power for driving the scan electrode. The second input terminal of the voltage multiplying circuit is connected to one end of the recovery capacitor. With this arrangement, a voltage required for the reset waveform generating circuit can be generated from the recovery capacitor charged with a voltage that is a half of the voltage of the dc power supply of the sustain pulse generating circuit, without a regulator.

The plasma display panel driving circuit may include a reset waveform generating circuit that generates a reset waveform to be applied to the scan electrode during the reset period. The voltage generated by the voltage multiplying circuit may be applied to the reset waveform generating circuit. With this arrangement, it is possible to omit a constant voltage power supply in the reset waveform generating circuit.

The voltage multiplying circuit may include: a first diode having an anode connected to the recovery capacitor; a second diode having an anode connected to the cathode of the first diode; a first pump-up capacitor having one end connected to the cathode of the first diode, and the other end to which either one of a predetermined voltage and the grounding potential can be selectively applied; a charging capacitor having one end connected to the cathode of the second diode, and the other end connected to the grounding potential; a third diode having an anode connected to the cathode of the second diode; and a second pump-up capacitor having one end connected to the cathode of the third diode and the other end to which either one of a predetermined voltage and the grounding potential can be selectively applied. With this arrangement, a voltage required for the reset waveform generating circuit can be obtained from the recovery capacitor charged with a voltage that is a half of the voltage of the constant voltage power supply used in the sustain pulse generating circuit, without the necessity of using a regulator.

Moreover, the plasma display apparatus of the present invention is characterized by installing the above-mentioned panel driving circuit. Therefore, it becomes possible to cut the number of elements in the panel driving circuit installed in the plasma display apparatus.

According to the present invention, a voltage ($Vx+n\times Vs$) obtained by adding a voltage of integral multiple of the first voltage (Vs) to the second voltage (Vx) that is smaller than the first voltage is generated by the voltage doubler circuit. Therefore, it is possible to generate a voltage of decimal multiple of the first voltage (Vs) using only the voltage-multiplying circuit without the regulator. Without the regulator, a voltage required for driving can be generated. Consequently, no regulator needs to be installed, and thus it is possible to provide a panel driving circuit or a plasma display apparatus which can reduce the number of elements composing the driving circuit.

DETAIL DESCRIPTION OF THE PREFERRED EMBODIMENT

Referring to the accompanying drawings, a preferred embodiment of a plasma display apparatus of the present invention is described below.

1. Configuration of Plasma Display Panel

Figure 1:
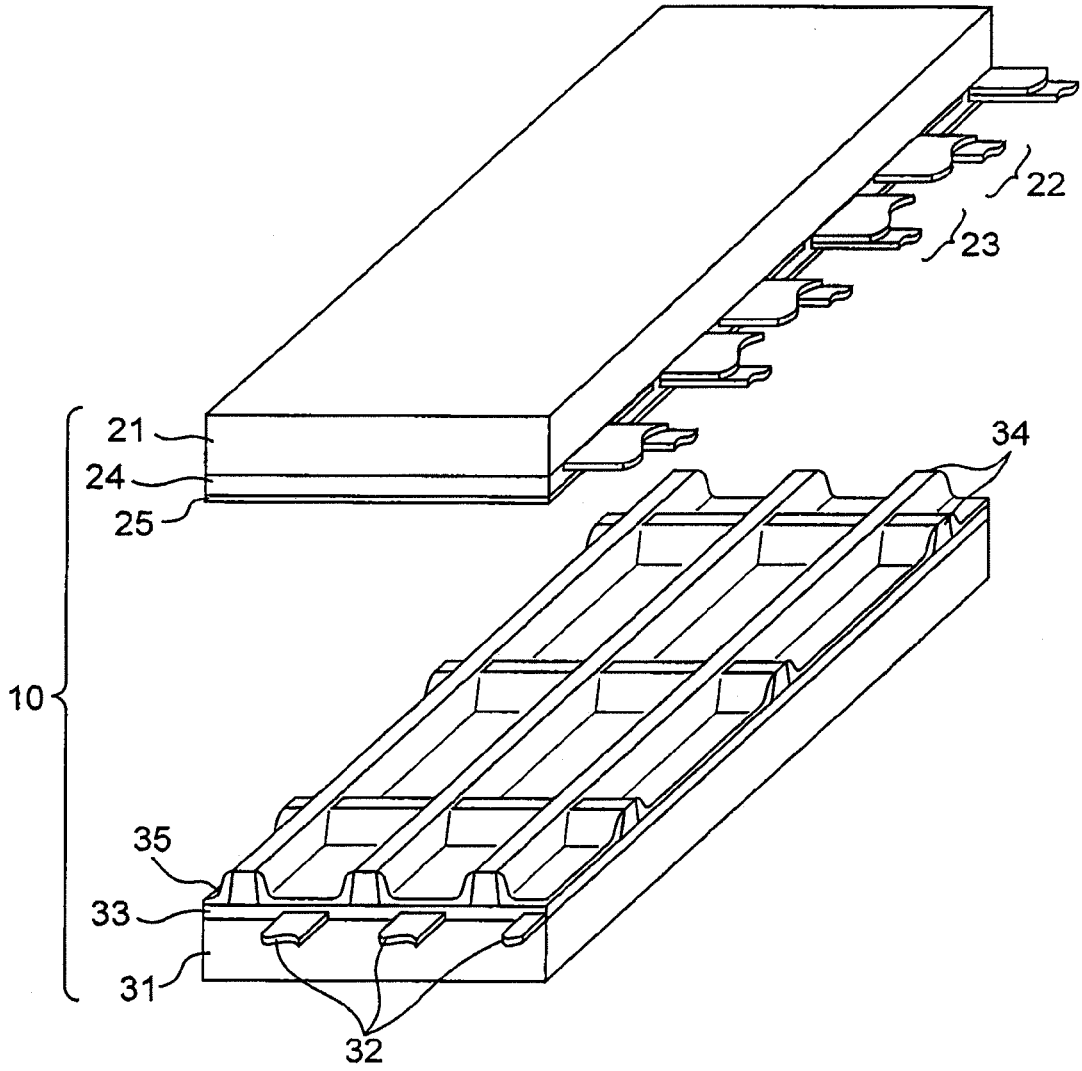
FIG. 1 is a perspective view showing a structure of a plasma display panel in accordance with embodiment 1 of the present invention.

FIG. 1 is a perspective view showing a configuration of a plasma display panel 10 in embodiment 1 of the present invention. On a front face plate 21 made of glass, as a first substrate, a plurality of display electrodes each of which is a pair of a stripe-shaped scan electrode 22 and a stripe-shaped sustain electrode 23, are formed. Moreover, a dielectric layer 24 is formed to cover the scan electrodes 22 and sustain electrodes 23, and a protective layer 25 is formed on the dielectric layer 24.

On a back face plate 31 as a second substrate, a plurality of stripe-shaped data electrodes 32 covered with a dielectric layer 33 are formed in a manner so as to cross the scan electrodes 22 and the sustain electrodes 23 three-dimensionally, A plurality of partition walls 34 are disposed on the dielectric layer 33 in parallel with the data electrodes 32. A phosphor layer 35 is formed on the dielectric layer 33 between the partition walls 34 as well as on sidewall of each partition wall 34. Moreover, each data electrode 32 is placed between the adjacent partition walls 34.

The front face plate 21 and back face plate 31 are arranged face to face with a fine discharge space interposed therebetween so as to allow the scan electrodes 22 and the sustain electrodes 23 to orthogonally cross the data electrodes 32, and the peripheral portion is sealed by a sealing material such as glass flit. Moreover, the discharge space is filled with a mixed gas of, for example, neon (Ne) and xenon (Xe), sealed therein as a discharge gas. The discharge space is divided into a plurality of sections by the partition walls 34, and phosphor layers 35 emitting respective lights of red (R), green (G) and blue (B) are successively disposed in the respective sections. Moreover, a discharge cell is formed at a portion where the scan electrode 22 and sustain electrode 23 intersect with the data electrode 32, so that one pixel is formed by three adjacent discharge cells in which the phosphor layers 35 that emit lights of the respective colors are formed. An area in which the discharge cells constituting the pixels are formed is an image display area, and a peripheral area of the image display area forms a non-display area in which no image is displayed, such as an area with glass flit formed.

Not limited to the above-mentioned configuration of the panel. For example, the panel may have stripe-shaped partition walls.

Figure 2:
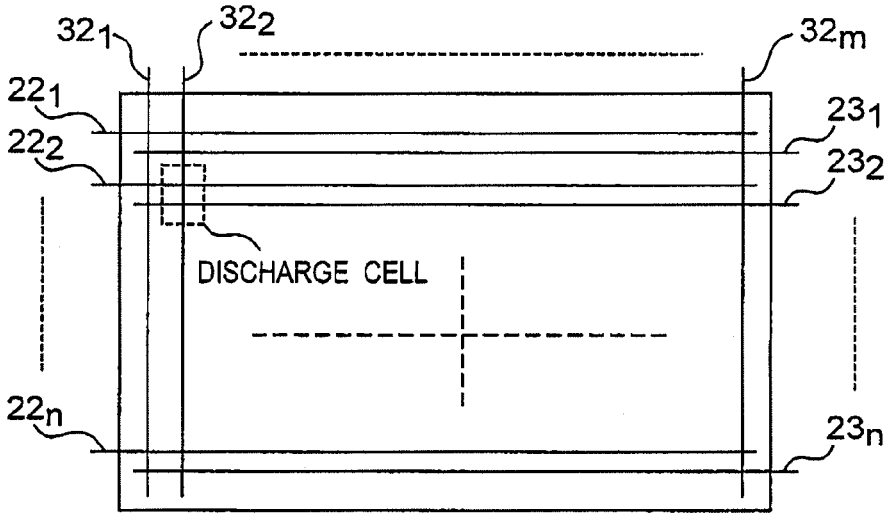
FIG. 2 is a view showing an arrangement of electrodes of the panel.

FIG. 2 is a drawing that shows an electrode arrangement of the panel 10 in the embodiment of the present invention. As shown in FIG. 2, on the panel 10, n-number of the scan electrodes 22 (scan electrodes $\mathbf{22}_1$ to $\mathbf{22}_n$ in the Figure) and n-number of the sustain electrodes 23 (sustain electrodes $\mathbf{23}_1$ to $\mathbf{23}_n$ in the Figure) are arranged in the row direction, and m-number of the data electrodes 32 (data electrodes $\mathbf{32}_1$ to $\mathbf{32}_m$ in the Figure) are arranged in the column direction. A discharge cell is formed at each portion at which a pair of the scan electrode 22 and the sustain electrode 23 intersect with the data electrode 32, and thus m×n-number of the discharge cells are formed in the discharge spaces.

In the panel 10 having this configuration, ultraviolet ray is generated by a gas discharge in each discharge cell so that the ultraviolet ray excites the phosphor of each color of R, G and B to emit a light, thus achieving color display. Moreover, the panel 10 carries out a gray scale display in a sub-field method, in which one field is divided into a plurality of sub-fields and the sub-fields to emit light are combined for gray scale display. Each sub-field includes a reset period, an address period and a sustain period. In the reset period, discharge is generated so that a wall charge required for the succeeding address operation is charged on each electrode. In the address period, an address discharge is selectively caused at discharge cells to be emitted so that a wall charge is charged thereon. In the sustain period, a sustain pulse is alternately applied to a pair of display electrodes including the scan electrode and sustain electrode so that a sustain discharge is caused in the discharge cell in which the address discharge is caused. Thus, the phosphor layer of the corresponding discharge cell emits light to carry out an image displaying operation. In this manner, in order to display image data, respectively different signal waveforms are applied to the respective electrodes depending on the reset period, the address period and the sustain period.

2. Driving Voltage Waveform of Plasma Display Panel

Figure 3:
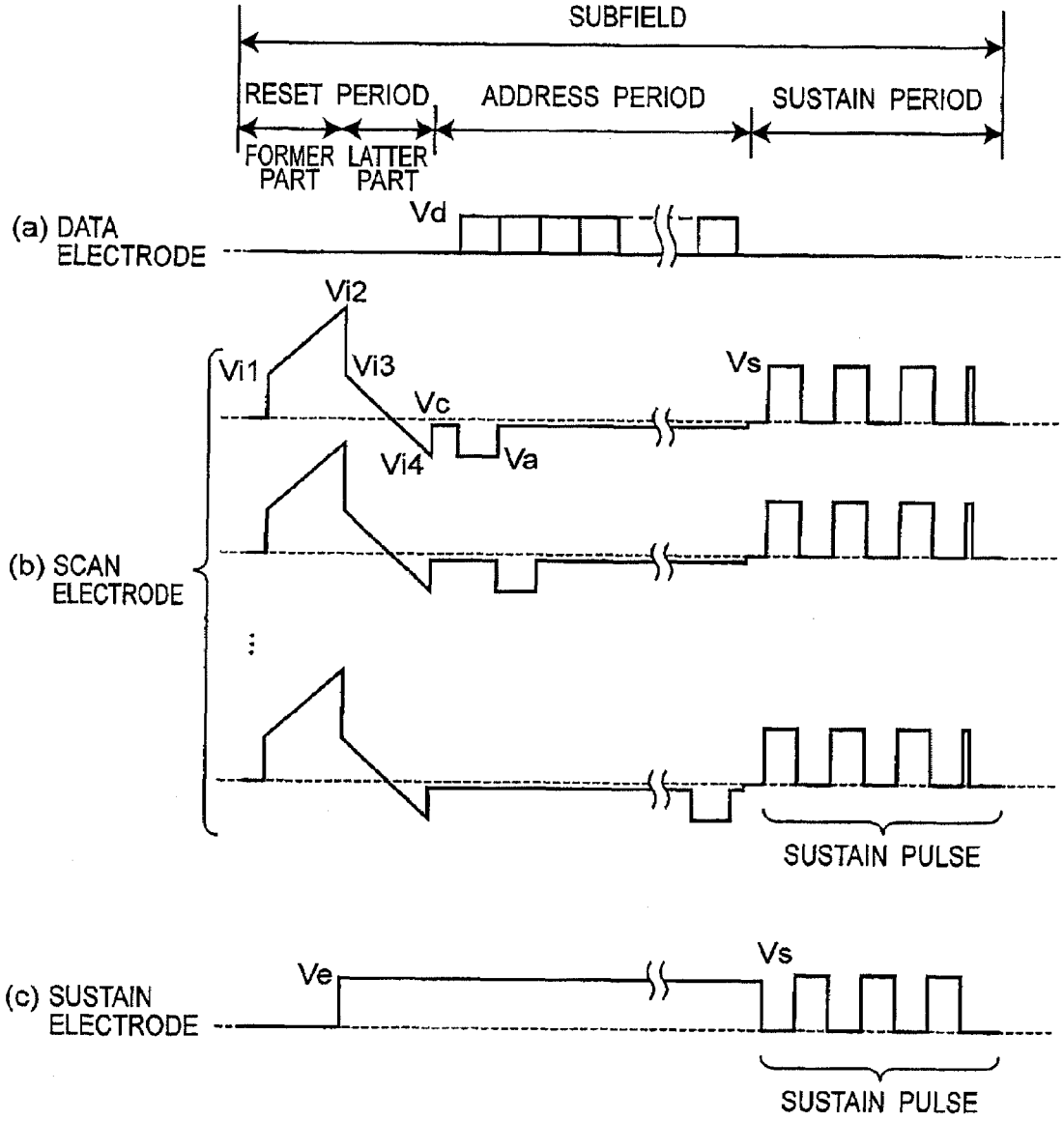
FIG. 3 is a drawing showing respective driving voltage waveforms to be applied to the respective electrodes of the panel.

FIG. 3 is a drawing that shows respective driving voltage waveforms to be applied to the respective electrodes of the panel 10 according to the preferred embodiment of the present invention. As shown in FIG. 3, in embodiment of the present invention, one field is divided into a plurality of sub-fields, and each of the sub-fields has the reset period, the address period and the sustain period. In the respective sub-fields, virtually the same operation is carried out except that the number of sustain pulses are made different in the sustain period so as to change the weights of the light-emitting periods, and the operation for the respective sub-fields is virtually the same. Hence, the following description of operation will be made for one exemplary sub-field.

First, in the reset period, for example, a positive pulse voltage is applied to all the scan electrodes $\mathbf{22}_1$ to $\mathbf{22}_n$ so that required wall charges are accumulated on the protective layer 25 on the dielectric layer 24 that covers the scan electrodes $\mathbf{22}_1$ to $\mathbf{22}_n$ and the sustain electrodes $\mathbf{23}_1$ to $\mathbf{23}_n$, as well as on the phosphor layer 35. In addition, the reset period generates a priming (a priming agent for discharging=exciting particles) used for causing an address discharge stably with a discharge delay being minimized.

More specifically, in the former part of the reset period, while the data electrodes $\mathbf{32}_1$ to $\mathbf{32}_n$ and the sustain electrodes $\mathbf{23}_1$ to $\mathbf{23}_n$ are respectively maintained at 0 (V), a ramp waveform voltage moderately rising from a voltage Vi1 (V) which is not more than the discharge start voltage to a voltage Vi2 (V) that exceeds the discharge start voltage with respect to the data electrodes $\mathbf{32}_1$ to $\mathbf{32}_m$ is applied to the scan electrodes $\mathbf{22}_1$ to $\mathbf{22}_n$. While the ramp waveform voltage is rising, a weak reset discharge takes place for the first time respectively between the scan electrodes $\mathbf{22}_1$ to $\mathbf{22}_n$ or sustain electrodes $\mathbf{23}_1$ to $\mathbf{23}_n$, and the data electrodes $\mathbf{32}_1$ to $\mathbf{32}_m$. Thus, while a negative wall voltage is accumulated on the upper portion of each scan electrode $\mathbf{22}_1$ to $\mathbf{22}_n$, a positive wall voltage is accumulated on the upper portion of each data electrode $\mathbf{32}_1$ to $\mathbf{32}_m$ as well as on the upper portion of each sustain electrode $\mathbf{23}_1$ to $\mathbf{23}_n$. Here, the wall voltage on the upper portion of each electrode means a voltage generated by the wall charge accumulated on the dielectric layer covering the electrodes as well as on the phosphor layer.

In the latter part of the reset period, while the sustain electrodes $\mathbf{23}_1$ to $\mathbf{23}_n$ are maintained at a positive voltage Ve (V), a ramp waveform voltage moderately declining from a voltage Vi3 that is not more than the discharge start voltage to a voltage Vi4 (V) with respect to the sustain electrodes $\mathbf{23}_1$ to $\mathbf{23}_n$ is applied to the scan electrodes $\mathbf{22}_1$ to $\mathbf{22}_n$. During the period, a weak reset discharge takes place in the second time respectively between the scan electrodes $\mathbf{22}_1$ to $\mathbf{22}_n$ and sustain electrodes $\mathbf{23}_1$ to $\mathbf{23}_n$ and the data electrodes $\mathbf{32}_1$ to $\mathbf{32}_m$. Thus, the negative wall voltage on the upper portion of each scan electrode $\mathbf{22}_1$ to $\mathbf{22}_n$ and the positive wall voltage on the upper portion of each sustain electrode $\mathbf{23}_1$ to $\mathbf{23}_n$ are weakened so that the positive wall voltage on the upper portion of each data electrode $\mathbf{32}_1$ to $\mathbf{32}_m$ is adjusted to an adequate value for the address operation. The reset operation is completed through the above-mentioned processes (hereinafter, the driving voltage waveform to be applied to each electrode during the reset period is referred to simply as "reset waveform").

Next, during the address period, a negative scan pulse is sequentially applied to all the scan electrodes $\mathbf{22}_1$ to $\mathbf{22}_n$ to perform scanning. During the scanning of the scan electrodes $\mathbf{22}_1$ to $\mathbf{22}_n$, a positive address pulse is applied to the data electrodes $\mathbf{32}_1$ to $\mathbf{32}_m$ based upon display data. Thus, an address discharge is generated between the scan electrode $\mathbf{22}_1$ to $\mathbf{22}_n$ and the data electrode $\mathbf{32}_1$ to $\mathbf{32}_m$, and a wall charge is accumulated on the surface of the protective layer 25 on the scan electrode $\mathbf{22}_1$ to $\mathbf{22}_n$.

More specifically, during the address period, the scan electrodes $\mathbf{22}_1$ to $\mathbf{22}_n$ are once held at a voltage Vc (V). Next, in the address operation of discharge cells $C_{p,1}$ to $C_{p,m}$ (p is an integer of 1 to n), while a scan pulse voltage Va (V) is being applied to a scan electrode $\mathbf{22}_p$, a positive address pulse voltage Vd (V) is applied to a data electrode $\mathbf{32}_q$ (data electrode which is to be selected based upon an image signal from data electrodes $\mathbf{32}_1$ to $\mathbf{32}_m$) corresponding to the image signal to be displayed at the p-th row among the data electrodes $\mathbf{32}_1$ to $\mathbf{32}_m$. Thus, the voltage of the discharge cell $C_{p,q}$ corresponding to the intersection between the data electrode $\mathbf{32}_q$ with the address pulse voltage applied thereto and the scan electrode $\mathbf{22}_p$ with the scan pulse voltage applied thereto becomes an externally applied voltage (Vd-Va) (V) plus the wall voltage on the data electrode $\mathbf{32}_q$ and the wall voltage on the scan electrode $\mathbf{22}_p$, so that the resulting voltage exceeds the discharge start voltage. Therefore, an address discharge is generated between the data electrode $\mathbf{32}_q$ and the scan electrode $\mathbf{22}_p$ as well as between the sustain electrode $\mathbf{23}_p$ and the scan electrode $22_p$. The address discharge causes a positive voltage to be accumulated on the upper portion of the scan electrode $22_p$ of the discharge cell $C_{p,q}$, so that a negative voltage is accumulated on the upper portion of the sustain electrode $23_p$. In this manner, an address operation is carried out, in which an address discharge is generated in the discharge cells to be displayed on the p-th row so that a wall voltage is accumulated on each electrode. In contrast, the voltage at the intersection between the data electrode $32_1$ to $32_m$ to which no positive address pulse voltage Vd (V) is applied and the scan electrode $22_p$ does not exceed the discharge start voltage, and thus no address discharge is generated. Thereafter, the same address operation is sequentially carried out up to the discharge cell $C_{n,q}$ on the n-th row, thereby completing the address period.

In the succeeding sustain period, a sufficient voltage for sustaining a discharge between the scan electrode $22_1$ to $22_n$ and sustain electrode $23_1$ to $23_n$ is applied thereto for a predetermined period. Consequently, a discharge plasma occurs between the scan electrode $22_1$ to $22_n$ and sustain electrode $23_1$ to $23_n$ to excite the phosphor layer 35 to emit light for a predetermined period. At this time, in the discharge spaces to which no address pulse is applied during the address period, no discharge occurs, no phosphor layer 35 is excited, and no light is emitted.

More specifically, during the sustain period, after the scan electrodes $22_1$ to $22_n$ are once returned to 0 (V), the sustain electrodes $23_1$ to $23_n$ are returned to 0 (V). Thereafter, a positive sustain pulse voltage Vs (V) is applied to the scan electrodes $22_1$ to $22_n$. At this time, the voltage between the upper portion of the scan electrode $22_p$ and the upper portion of the sustain electrode $23_p$ at the discharge cell $C_{p,q}$ that has caused the address discharge becomes a voltage equivalent to the positive sustain pulse voltage Vs (V) plus the wall voltage accumulated on the upper portion of the scan electrode $22_p$ and the upper portion of the sustain electrode $23_p$ during the address period, consequently exceeding the discharge start voltage. Then, a sustain discharge in the first time is generated between the scan electrode $22_p$ and the sustain electrode $23_p$. In the discharge cell $C_{p,q}$ that has caused the sustain discharge, a negative voltage is accumulated on the upper portion of the scan electrode $22_p$ so as to cancel the potential difference between the scan electrode $22_p$ and the sustain electrode $23_p$ on the generation of the sustain discharge, so that a positive voltage is accumulated on the upper portion of the sustain electrode $23_p$. At this time, a positive wall voltage is also accumulated on the data electrode $32_q$. Moreover, in the discharge cell in which no address discharge is generated during the address period, no sustain discharge is generated so that the wall voltage state at the completion of the reset period is maintained. Thus, the sustain discharge in the first time is completed. After the sustain discharge in the first time, the scan electrodes $22_1$ to $22_n$ are returned to 0 (V), a positive sustain pulse voltage Vs (V) is applied to the sustain electrodes $23_1$ to $23_n$. At this time, in the discharge cell $C_{p,q}$ that has caused the sustain discharge in the first time, the voltage between the upper portion of the scan electrode $22_p$ and the upper portion of the sustain electrode $23_p$ becomes equivalent to the positive sustain pulse voltage Vs (V) plus the wall voltage accumulated on the upper portion of the scan electrode $22_p$ and the upper portion of the sustain electrode $23_p$ by the sustain discharge in the first time, and consequently becomes greater than the discharge start voltage, thereby generating a sustain discharge in the second time. The second sustain discharge causes a negative voltage to be accumulated on the sustain electrode $23_p$ and a positive voltage to be accumulated on the scan electrode $22_p$. Thereafter, in the same manner, the number of sustain pulses which corresponds to weights for luminescence are alternately applied to the scan electrodes $22_1$ to $22_n$ and the sustain electrodes $23_1$ to $23_n$ so that sustain discharges the number of which corresponds to the number of sustain pulses are continuously generated in the discharge cell $C_{p,q}$ that has caused an address discharge during the address period. Then, a sustaining operation in the sustain period is completed.

3. Configuration of Plasma Display Apparatus

Figure 4:
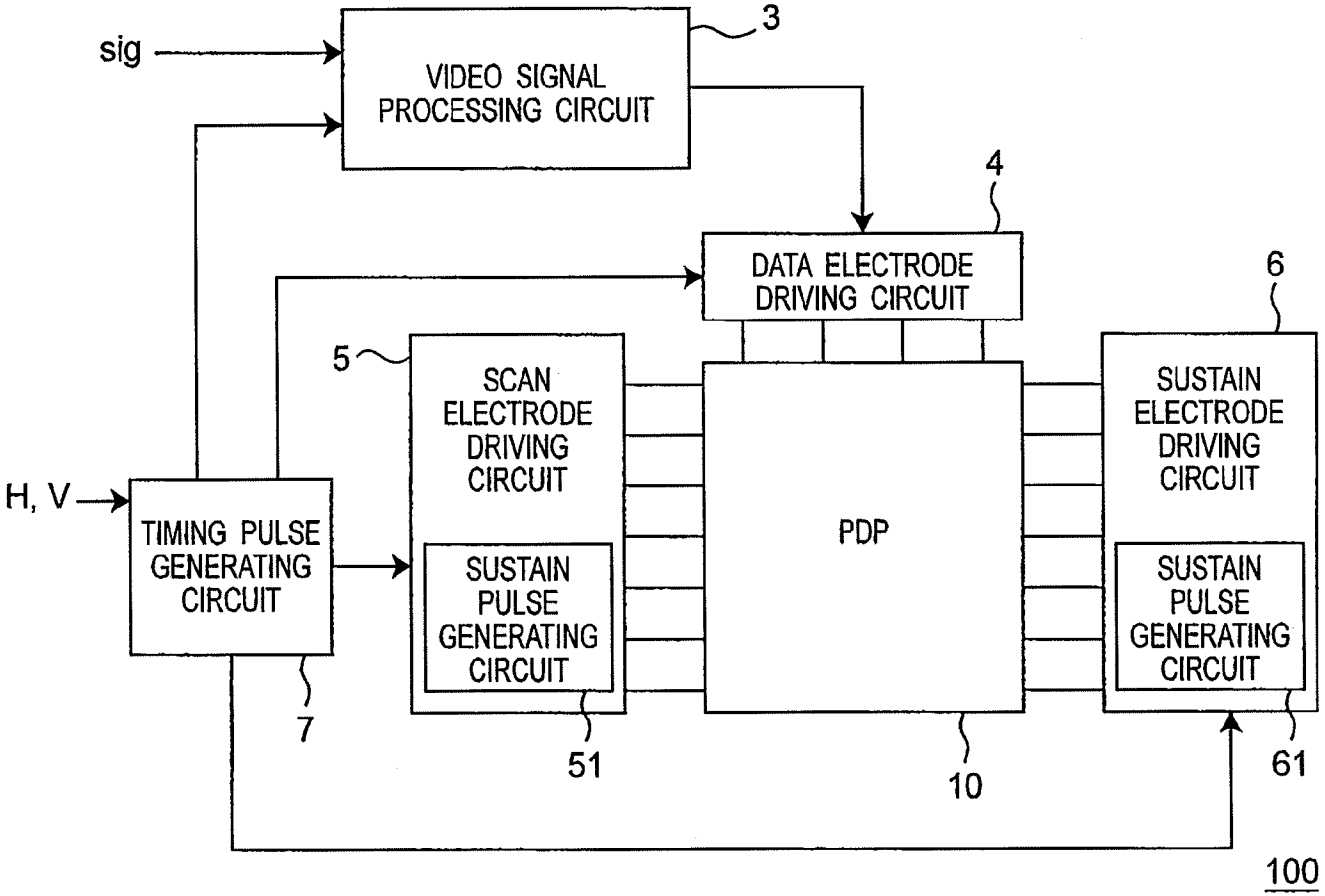
FIG. 4 is a block diagram showing an electrical structure of a plasma display apparatus using the panel.

FIG. 4 is a block diagram that shows a configuration of a plasma display apparatus 100 using the panel 10 according to the embodiment of the present invention. The plasma display apparatus 100 shown in FIG. 4 includes a panel 10, image signal processing circuit 3, data electrode driving circuit 4, a scan electrode driving circuit 5, a sustain electrode driving circuit 6, a timing generating circuit 7 and a power supply section (not shown) that supplies a necessary voltage to each circuit block.

The image signal processing circuit 3 converts an inputted analog image signal (sig) into a digital image signal in order to emit light for display of the digital image signal on the panel 10 based upon combinations of a plurality of sub-fields having different weights in light-emitting period, one field of the image signal is converted into sub-field data for controlling emission/non-emission of light for each sub-field. Moreover, a control signal for the data electrode driving circuit, a control signal for the scan electrode driving circuit, and a control signal for the sustain electrode driving circuit are generated from the sub-field data, and provided to the data electrode driving circuit 4, the scan electrode driving circuit 5, and the sustain electrode driving circuit 6, respectively.

The timing pulse generating circuit 7 generates various timing signals for controlling driving voltage waveforms of the respective electrode driving circuits based upon a horizontal synchronous signal H and a vertical synchronous signal V, and supplies these to the respective circuit blocks.

The panel 10, as described above, has a structure in which scan electrodes $22_1$ to $22_n$ on n-number of rows (scan electrodes 22 in FIG. 1) and sustain electrodes $23_1$ to $23_n$ on n-number of rows (sustain electrodes 23 in FIG. 1) are alternately arranged in the row direction, and data electrodes $32_1$ to $32_m$ on m-number of columns (data electrodes 32 in FIG. 1) are arranged in the column direction. Moreover, (m×n)-number of discharge cells $C_{i,j}$, each including a pair of scan electrode $22_i$ and sustain electrode $23_i$ (i=1 to n) as well as one data electrode $32_j$ (j=1 to m), are formed in discharge spaces so that one pixel is constituted by three discharge cells that emit lights of respective red, green and blue.

The data electrode driving circuit 4 converts image data for each sub-field to a signal relating to each data electrode 32 and drives each data electrode $32_j$ independently.

Moreover, the scan electrode driving circuit 5 includes a sustain pulse generating circuit 51 for generating sustain pulses to be applied to the scan electrodes $22_1$ to $22_n$ during the sustain period, and can drive the respective scan electrodes $22_1$ to $22_n$ independently. Thus, based upon the control signals for the scan electrode driving circuit, it drives the respective scan electrodes $22_1$ to $22_n$ independently.

The sustain electrode driving circuit 6 includes a circuit for applying a predetermined voltage Ve (V) to the sustain electrodes $23_1$ to $23_n$ during the reset period and the address period and a sustain pulse generating circuit 61 for generating sustain pulses to be applied to the sustain electrodes $23_1$ to $23_n$ during the sustain period, and can drive all the sustain electrodes $23_1$ to $23_n$ of the panel 10 at one time. Thus, based upon the control signals for the sustain electrode driving circuit, it drives the sustain electrodes $23_1$ to $23_n$ at one time.

3.1 Scan Electrode Driving Circuit

Figure 5:
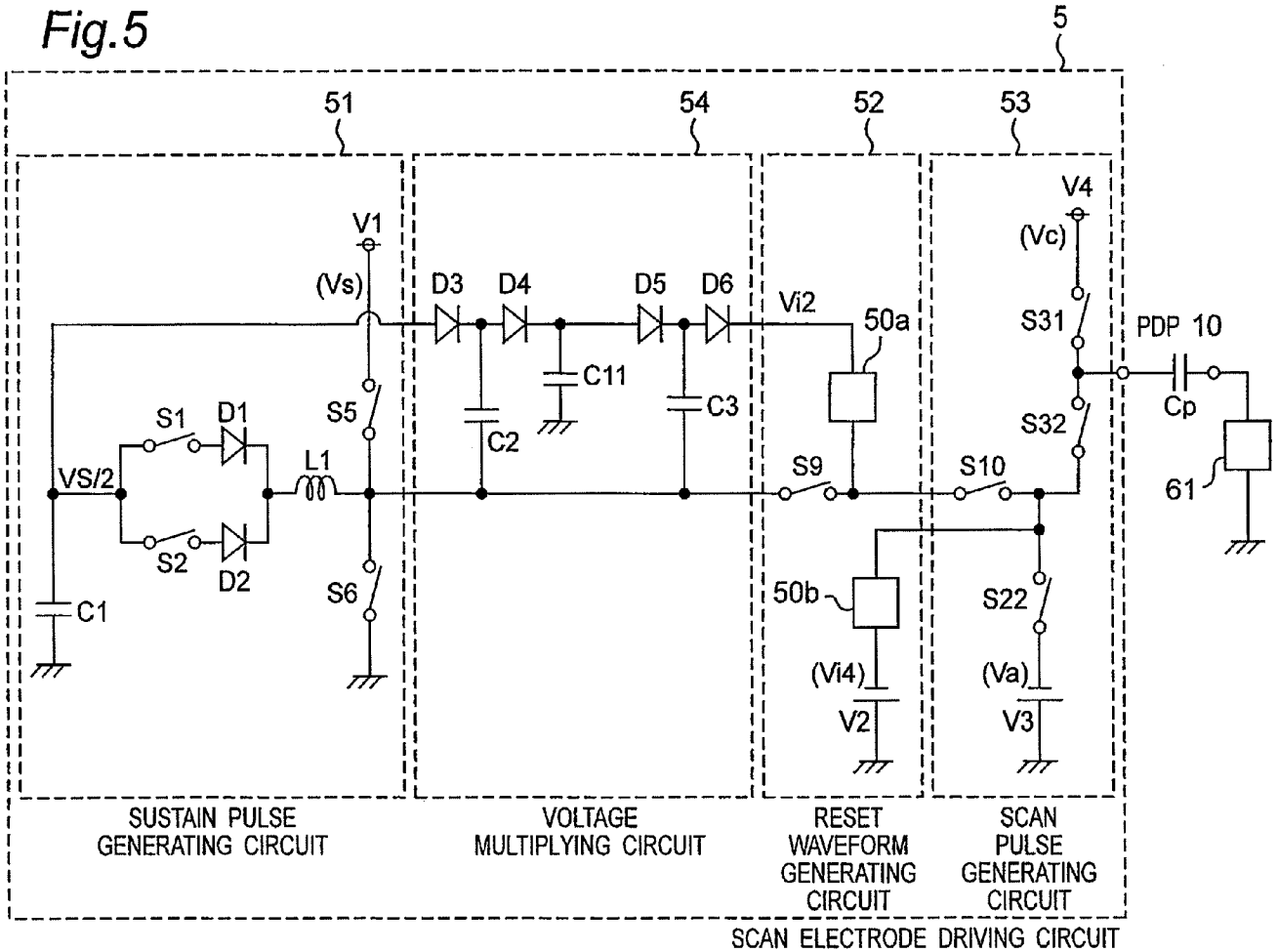
FIG. 5 is a circuit diagram showing a scan electrode driving circuit for driving the scan electrodes of the panel.

The following description will discuss the scan electrode driving circuit 5 in detail. FIG. 5 is a circuit diagram of the scan electrode driving circuit 5 for driving the scan electrodes 22 of the panel 10 in accordance with embodiment of the present invention. The scan electrode driving circuit 5 shown in FIG. 5 includes a sustain pulse generating circuit 51, an address waveform generating circuit 52, a scan pulse generating circuit 53 and a voltage multiplying circuit 54, and drives the scan electrodes $22_1$ to $22_n$. In FIG. 5, the capacity between electrodes of the panel 10 is indicated as Cp.

The sustain pulse generating circuit 51 has a structure in which a resonance circuit provided with an inductor, that is, a power recovery circuit. The sustain pulse generating circuit 51 recovers power, accumulated in a capacitive load (capacitive load formed in the scan electrodes $22_1$ to $22_n$) in the panel 10, and reuses the recovered power as driving power for the scan electrodes $22_1$ to $22_n$, thus resulting in reduction of power consumption.

More specifically, the sustain pulse generating circuit 51 is composed of a power recovery section having a coil L1, a recovery capacitor C1, switching elements S1 and S2, and reverse current blocking diodes D1 and D2, and a voltage clamp section having switching elements S5 and S6 and a constant voltage power supply V1 having a voltage Vs (V) The power recovery section uses the coil L1 as an inductance element, the capacitive load (capacitive load formed in the scan electrodes $22_1$ to $22_n$) of the panel 10, and the coil L1 to cause the capacitive load of the panel 10 and the coil L1 to resonate, thus achieving recovery and supply of power. Upon recovering power, power accumulated in the capacitive load formed in the scan electrodes $22_1$ to $22_n$, is transferred to the recovery capacitor C1 through the reverse current blocking diode D2 and the switching element S2. Upon supplying power, the power accumulated in the recovery capacitor C1 is transferred to the panel 10 (scan electrodes $22_1$ to $22_n$) through the switching element S1 and the reverse current blocking diode D1. Thus, a driving operation is carried out on the scan electrodes $22_1$ to $22_n$ during the sustain period. Therefore, in the power recovery section, since the scan electrodes $22_1$ to $22_n$ are driven using the LC resonance without supplying power from the power supply during the sustain period, the substantive power consumption becomes zero. The recovery capacitor C1 has a capacitance that is sufficiently large in comparison with the capacity Cp between the electrodes of the panel 10, and is charged to a voltage Vs/2 (V) that is half of the voltage Vs (V) of the predetermined power supply V1, Hence the recovery capacitor C1 functions as a power supply for the power recovery section.

Here, the voltage clamp section applies a voltage Vs (V) to the scan electrodes $22_1$ to $22_n$ from the constant voltage power supply V1 of a voltage Vs (V) through the switching element S5 so as to clamp the scan electrodes $22_1$ to $22_n$ to the voltage Vs (V), while also clamping the scan electrodes $22_1$ to $22_n$ to the grounding potential through the switching element S6, so that the scan electrodes $22_1$ to $22_n$ are driven. Therefore, upon driving the scan electrodes $22_1$ to $22_n$ using the voltage clamp section, a power consumption is caused by supplied power from the power supply. However, since the impedance at this time is very small, the rise and fall of the sustain pulse becomes steep.

Thus, the sustain pulse generating circuit 51 switches the power recovery section and the voltage clamp section by switching the switching elements S1, S2, S5 and S6 to generate a sustain pulse to be applied to the scan electrodes $22_1$ to $22_n$. In this manner, in the sustain pulse generating circuit 51 which utilizes the LC resonance, the power recovery section supplies power until the voltage of the sustain pulse becomes a local maximum value, and then makes a switch to the voltage clamp section. Hence, it is possible to carry out a driving operation in which the power recovery section whose power consumption is theoretically zero is utilized to its full extent, and thus it becomes possible to reduce the power consumption of the scan electrode driving circuit 5.

Here, the switching elements S1, S2, S5 and S6 are formed by generally known elements used for carrying out switching operations, such as MOSFET and the like, and the switching is controlled based upon sub-field control signals formed in the image-signal processing circuit 3. Moreover, switching elements to be described in the following explanation are also made of elements such as MOSFETs in the same manner, and supposed to be switching-controlled based upon sub-field control signals formed by the image-signal processing circuit 3.

The voltage multiplying circuit 54 converts the voltage Vs/2 (V) of the recovery power accumulated in the recovery capacitor C1 to 2.5 Vs (V) which is 5 times as high as its voltage, that is, to a voltage Vi2 (V), and supplies it to the reset waveform generating circuit 52. The detailed description thereof will be given later.

The reset waveform generating circuit 52 includes a constant voltage power supply V2 having a negative voltage value Vi4 (V) and mirror integrators 50*a* and 50*b*, and generates the aforementioned reset waveform using the voltage Vi2 (2.5 Vs) (V) supplied from the voltage multiplying circuit 54.

The mirror integrator 50*a* having one end connected to the voltage multiplying circuit 54 raises the voltage to be applied to the scan electrodes $22_1$ to $22_n$ gradually from the voltage Vi1 (V) to the positive reset voltage Vi2 (V) to be supplied by the voltage multiplying circuit 54 in a ramp shape. Thereafter, the mirror integrator 50*b* having one end connected to the constant voltage power supply V2 decreases the voltage to be applied to the scan electrodes $22_1$ to $22_n$ gradually from the voltage Vi3 (V) to the negative reset voltage Vi4 (V) by the constant voltage power supply V2 in a ramp shape. In other words, in the former part of the reset period, a lamp waveform that gradually increases from the voltage Vi1 (V) that is not more than the discharge start voltage to the voltage Vi2 (V) that exceeds the discharge start voltage with respect to the data electrodes $32_1$ to $32_m$ is generated. In the latter part of the reset period, a lamp waveform that gradually decreases from the voltage Vi3 (V) that is not more than the discharge start voltage to a voltage Vi4 (V) with respect to the sustain electrodes $23_1$ to $23_n$ is generated. Such a lamp waveform is applied to the scan electrodes $22_1$ to $23_n$.

The switching element S9 is inserted so as to electrically connect the sustain pulse generating circuit 51 to the scan electrodes $22_1$ to $22_n$ during the sustain period, and to electrically disconnect the sustain pulse generating circuit 51 from the other circuits during the other periods, and allowed to be turned on only during the sustain period. This is because, for example, when the reset voltage Vi2 (V) is being applied from the reset waveform generating circuit 52 to the scan electrodes $22_1$ to $22_1$ an influence from the constant voltage power supply V1 of the sustain pulse generating circuit 51 that has a potential lower than the potential of Vi2 can be removed.

The scan pulse generating circuit 53 includes a constant voltage power supply V3 having a negative voltage Va (V), a constant voltage power supply V4 having a voltage Vc (V), a switching element S22 that is connected to the constant voltage power supply V3 so that the reference potential of the scan electrode driving circuit 5 is set to the negative scan pulse voltage Va (V), a switching element S31 that superposes the voltage Vc (V) on the reference potential of the scan electrode driving circuit 5, and a switching element S32 for applying the reference potential of the scan electrode driving circuit 5 to the scan electrodes $22_1$ to $22_n$. Here, each of the switching elements S31 and S32 is constituted by n-number of switching elements so as to apply scan pulses to the n-number of scan electrodes $22_1$ to $22_n$, respectively Moreover, during the address period, a negative scan pulse is sequentially applied to all the scan electrodes $22_1$ to $22_n$ so that a scanning operation is carried out. In other words, the switching element S31 and the switching element S32 are alternately switched so as to supply either one of the voltages of the voltage value Vc (V) supplied from the constant voltage power supply V4 and the negative voltage value Va (V) supplied from the constant voltage power supply V3 to the scan electrodes $22_1$ to $22_n$; thus, the switching operations are carried out in such a manner that, at the timing in which the negative scan pulse is to be applied, the voltage from the constant voltage power supply V3 is supplied to the scan electrodes $22_1$ to $22_n$, and at the other timings, the voltage from the constant voltage power supply V4 is supplied thereto.

The switching element S10 is inserted so as to electrically connect the sustain pulse generating circuit 51 or the reset waveform generating circuit 52 to the scan electrodes $22_1$ to $22_n$, as required, and to electrically disconnect the sustain pulse generating circuit 51 or the reset waveform generating circuit 52 from the scan pulse generating circuit 53 at the other times. That is, the switching element S10 is turned on during the sustain period and the reset period. This is because, for example, when supplying the negative voltage from the constant voltage power supply V3 in the scan pulse generating circuit 53, an influence from a higher potential, that is, the grounding potential of the clamp section of the sustain pulse generating circuit 51, can be removed.

An arrangement may be adopted in which the constant voltage power supply V2 of the negative voltage value Vi4 (V) to be used in the reset waveform generating circuit 52 is used as the constant voltage power supply V3 of the negative voltage value Va (V) to be used in the scan pulse generating circuit 53, and vice versa.

The sustain pulse generating circuit 61 of the sustain electrode driving circuit 6 connected to the sustain electrodes 23 of the panel 10 shown in FIG. 5 includes a power recovery circuit, and is arranged to recover power accumulated in the capacitive load (capacitive load formed in the sustain electrodes $23_1$ to $23_n$) of the panel 10 and reuse the recovered power as driving power for the sustain electrodes $23_1$ to $23_n$. Since the structure and operational principle thereof are the same as those of the sustain pulse generating circuit 51 in the scan electrode driving circuit 5, the detail description thereof is omitted.

3.1.1 Voltage Multiplying Circuit

The following description will discuss the voltage multiplying circuit 54 in detail. In the present embodiment, the voltage Vi2 (V) to be used in the reset waveform generating circuit 52 is set to 2.5 Vs (V) which is about 2.5 times the voltage Vs (V) of the constant voltage power supply V1 in the sustain pulse generating circuit 51. That is, it is five times the voltage Vs/2 (V) of the recovery capacitor C1 in the sustain pulse generating circuit 51. Therefore, in the present embodiment, the voltage multiplying circuit 54 generates a voltage 2.5 Vs (V) that is 5 times the voltage Vs/2 (V) of the recovery capacitor C1, and supplies the voltage to the reset waveform generating circuit 52 as the voltage Vi2 (V). For this reason, one of the input terminals of the voltage multiplying circuit 54 is connected to the high-voltage side terminal of the recovery capacitor C1. Moreover, the other input terminal of the voltage multiplying circuit 54 is connected to a junction point between the switching element 35 and the switching element S6. The voltage Vs supplied from the power supply V1 or zero (volt) supplied from the ground is applied to the junction point between the switching element S5 and the switching element S6. With this arrangement, the voltage multiplying circuit 54 can generate a voltage provided by adding a voltage of integral multiple of the voltage (Vs) supplied from the power supply V1 to the voltage (Vs/2) supplied from the recovery capacitor C1.

The voltage multiplying circuit 54 includes a reverse current blocking diode D3 as a first diode, a reverse-current blocking diode D4 as a second diode, a reverse-current blocking diode D5 as a third diode, a reverse-current blocking diode D6, a pump-up capacitor C2 as a first pump-up capacitor, a pump-up capacitor C3 as a second pump-up capacitor, and a charging capacitor C11.

In the voltage multiplying circuit 54, first, a voltage 1.5 Vs (V) is obtained from the voltage Vs/2 (V) by means of the reverse-current blocking diodes D3 and D4, the pump-up capacitor C2 and the charging capacitor C1. The reverse current blocking diode D3 has its anode connected to the recovery capacitor C1 of the sustain pulse generating circuit 51, and also has its cathode connected to the anode of the reverse current blocking diode D4 and one end of the pump-up capacitor C2. Moreover, the other end of the pump-up capacitor C2 is connected to a junction point of the sustain pulse generating circuit 51 at which the switching element S5 and the switching element S6 are connected. With this arrangement, the voltage to be applied to one end of the pump-up capacitor C2 is switched to either one of the voltage Vs (V) and the grounding potential depending on the switching operations of the switching elements S5 and S6.

In this arrangement, first, when the switching element S5 is turned off and the switching element S6 is turned on, one end of the pump-up capacitor C2 is set to the grounding potential so that power of the voltage Vs/2 (V) is accumulated in the pump-up capacitor C2 from the recovery capacitor C1 through the reverse current blocking diode D3. In order to prevent a problem of a voltage drop of the recovery capacitor C1 due to that operation, the recovery capacitor C1 having a relatively larger capacity than the pump-up capacitor C2 is used.

Next, when the switching element S6 is turned off and the switching element S5 is turned on, a voltage Vs (V) derived from the constant voltage power supply V1 is applied to one end of the pump-up capacitor C2. Thus, the potential of one end of the pump-up capacitor C2 is raised (pumped up) from the grounding potential to the voltage Vs (V), and the voltage of the terminal on the high voltage side of the pump-up capacitor C2 is pumped up to a voltage 1.5 Vs (V) that is provided by adding the voltage Vs (V) to the voltage Vs/2 (V). The power accumulated in the pump-up capacitor C2 flowing reversely to the recovery capacitor C1 is prevented by function of the reverse-current blocking diode D3.

Thus, the voltage of the pump-up capacitor C2 is set to the voltage Vs/2 (V) with the switching element S5 turned off and the switching element S6 turned on, or is set to the voltage 1.5 Vs (V) with the switching element S6 turned off and the switching element S5 turned on. With this arrangement, the voltage Vs/2 (V) and the voltage 1.5 Vs (V) are alternately outputted from the cathode of the reverse current blocking diode D4 depending on the switching operations of the switching elements 35 and S6.

The reverse current blocking diode D4 has its cathode connected to a charging capacitor C11. Moreover, one end of the charging capacitor C11 is fixed to the grounding potential, and the reverse-current blocking diode D4 has a function for preventing a current from reversely flowing. Therefore, power of the voltage 1.5 Vs (V) outputted from the reverse current blocking diode D4 is accumulated in the charging capacitor C11 so that the voltage of the charging capacitor C11 is fixed to the voltage 1.5 Vs (V).

Successively, the voltage multiplying circuit 54 converts the voltage 1.5 Vs (V) to the voltage 2.5 Vs (V) using the reverse current blocking diode D5 and the pump-up capacitor C3. The reverse-current blocking diode D5 has its anode connected to the charging capacitor C11 and its cathode connected to one end of the pump-up capacitor C3. Moreover, the other end of the pump-up capacitor C3 is connected to a junction portion of the sustain pulse generating circuit 51 at which the switching element S5 and the switching element S6 are connected. With this arrangement, a voltage to be applied to one end of the pump-up capacitor C3 is switched to either one of the voltage Vs (V) and the grounding potential depending on the switching operations of the switching elements S5 and S6.

With this arrangement, first, when the switching element S5 is turned off and the switching element S6 is turned on, one end of the pump-up capacitor C3 is set to the grounding potential so that power of the voltage 1.5 Vs (V) is accumulated in the pump-up capacitor C3 from the charging capacitor C11 through the reverse-current blocking diode D5.

Next, when the switching element S6 is turned off and the switching element S5 is turned on, a voltage Vs (V) derived from the constant voltage power supply V1 is applied to the terminal on the low voltage side of the pump-up capacitor C3. Thus, the potential of the terminal on the low voltage side of the pump-up capacitor C3 is raised from the grounding potential to the voltage Vs (V), and the voltage of the terminal on the high voltage side of the pump-up capacitor C3 is pumped up to a voltage 2.5 Vs (V) that is provided by adding the voltage Vs (V) to the voltage 1.5 Vs (V). The power, accumulated in the pump-up capacitor C3 does not reversely flow to the charging capacitor C11 due to the function of the reverse current blocking diode D5. Moreover, the anode of the reverse current blocking diode D6 is connected to the capacitor C3 so that a voltage of the capacitor C3 is outputted from the cathode of the diode D6 in a stable manner by the function of the reverse current blocking diode D6.

Thus, the voltage of the pump-up capacitor C3 is set to the voltage 1.5 Vs (V) with the switching element S5 turned off and the switching element S6 turned on, and is also set to the voltage 2.5 Vs (V) with the switching element S6 turned off and the switching element S5 turned on. With this arrangement, the voltage 1.5 Vs (V) and the voltage 2.5 Vs (V) are alternately outputted from the cathode of the reverse current blocking diode D6 depending on the switching operations of the switching elements S5 and S6.

In other words, in the present embodiment, in order to generate sustain pulses during the sustain period, first, the switching elements S5 and S6 in the sustain pulse generating circuit 51 are turned on alternately so that power is accumulated in the charging capacitor C11 from the recovery capacitor C1 of the voltage Vs/2 (V) through the reverse current blocking diodes D3 and D4 and the pump-up capacitor C2. Thus, the voltage of the charging capacitor C11 is set to the voltage 1.5 Vs (V) Then, power is accumulated in the pump-up capacitor C3 from the charging capacitor C11 through the reverse current blocking diode D5.

In the succeeding reset period, the switching element S5 is turned on and the switching element S6 is turned off, and thus the voltage Vs (V) of the constant voltage power supply V1 is applied to the terminal on the low voltage side of the pump-up capacitor C3. Consequently, the potential on the terminal on the low voltage side of the pump-up capacitor C3 is pumped up so that the voltage 2.5 Vs (V) can be retrieved from the pump-up capacitor C3. Thus, during the reset period, the pump-up capacitor C3 can be operated as a power supply for supplying a voltage of 2.5 Vs (V), that is, the voltage Vi2 (V). Accordingly, the voltage Vi2 (V) can be supplied to the reset waveform generating circuit 52 without use of a constant voltage power supply and a regulator.

4. Conclusion

As explained above, in the panel driving circuit of the present embodiment, taking into consideration the fact that the voltage of the recovery capacitor C1 in the sustain pulse generating circuit 51 is the voltage Vs/2 (V), that is, half of the voltage Vs (V) of the constant voltage power supply V1, the constant voltage power supply V1 or the grounding potential is connected to one of the input terminals of the voltage multiplying circuit 54, and the recovery capacitor C1 is connected to the other input terminal. With this arrangement, it is possible to generate a 2.5 Vs (V) provided by multiplying the output voltage (Vs) of the constant voltage power supply (Vs) by 2.5 (decimal number multiplication), that is, the voltage Vi2 (V), only using the voltage multiplying circuit circuit 54. Therefore, in the reset waveform generating circuit 52, it is possible to omit the constant voltage power supply and the regulator to be used for generating the voltage Vi2 (V), and consequently to cut the number of elements composing the scan electrode driving circuit 5.

Additionally, in the voltage multiplying circuit 54 of the present embodiment, adding a set of a pump-up capacitor and a reverse current blocking diode allows generation of a higher voltage such as 3.0 Vs (V) and 3.5 Vs (V). In other words, depending on the number of set of circuit composed of the pump-up capacitor and the reverse current blocking diode, any voltage of (Vs/2+n×Vs) (n=2, 3, 4, . . . ) can be desirably obtained.

The present embodiment describes an arrangement, as shown in FIG. 5, in which the switching elements S5 and S6 of the clamping section in the sustain pulse generating circuit 51 also operates as switching elements for carrying out switching operations of the pump up in the voltage multiplying circuit 54. However, not limited to this arrangement, switching elements for carrying out the switching operations of the pump up may be provided separately from the switching elements S5 and S6.

Figure 6:
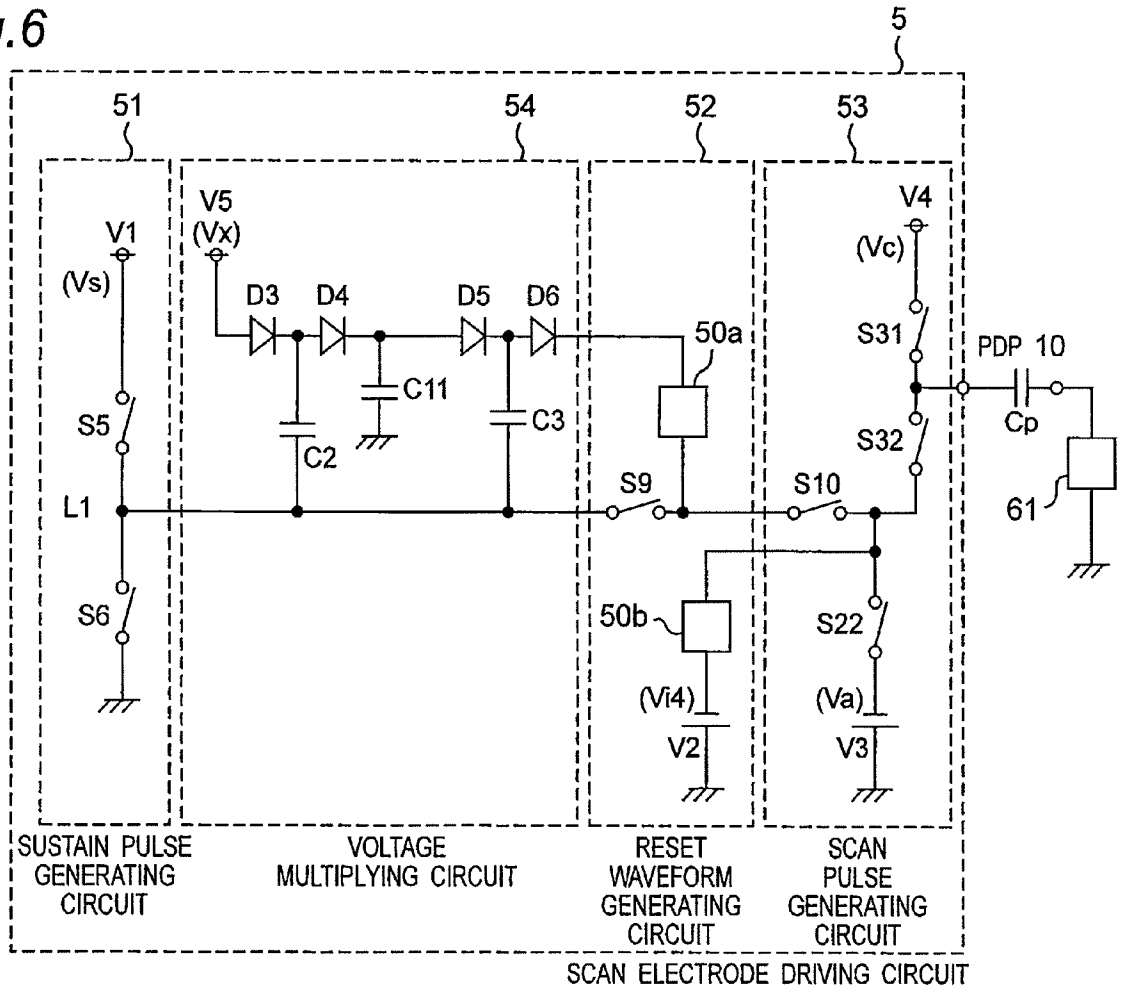
FIG. 6 is another circuit diagram showing a scan electrode driving circuit for driving the scan electrodes of the panel.
Figure 7:
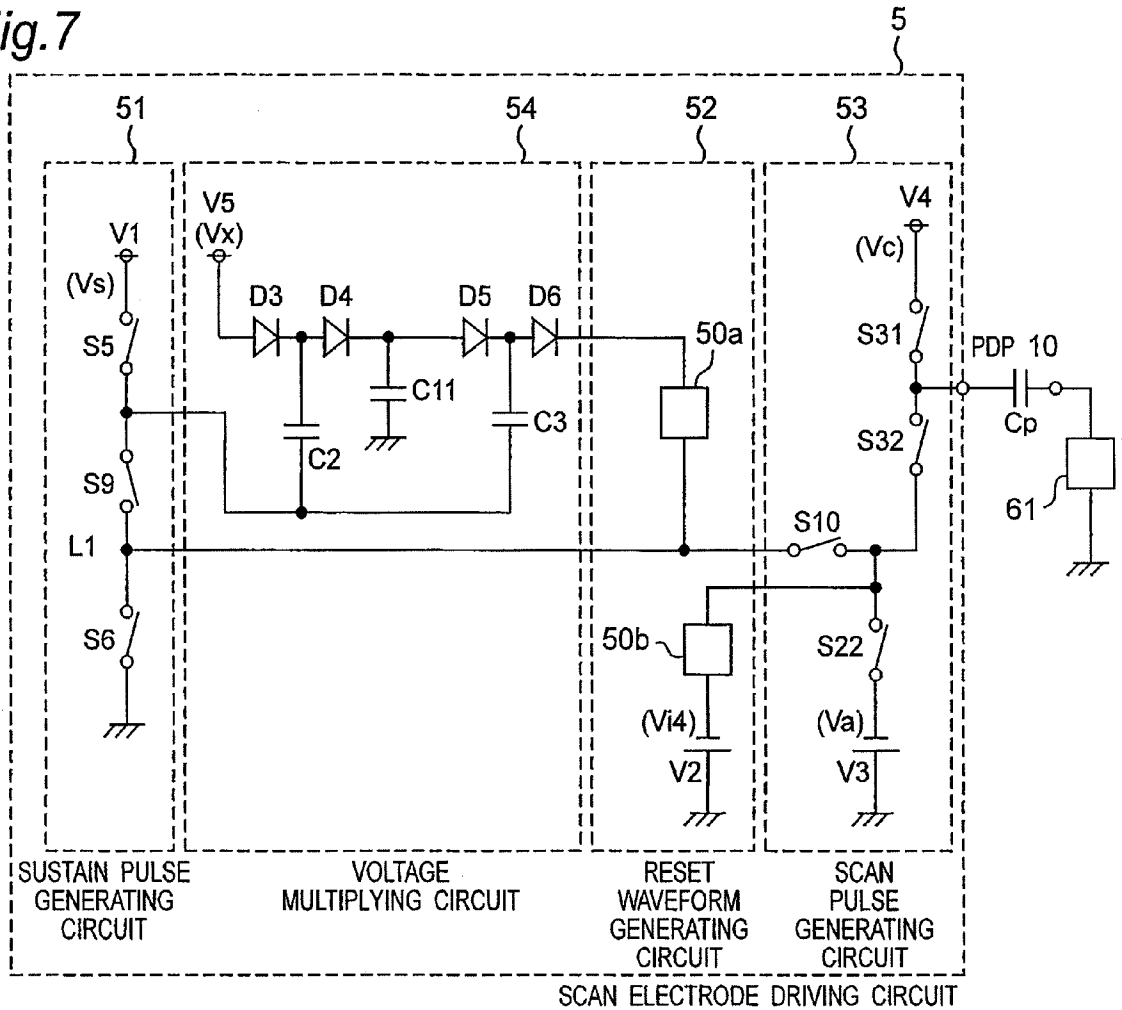
FIG. 7 is the other circuit diagram showing a scan electrode driving circuit for driving the scan electrodes of the panel.
Figure 8:
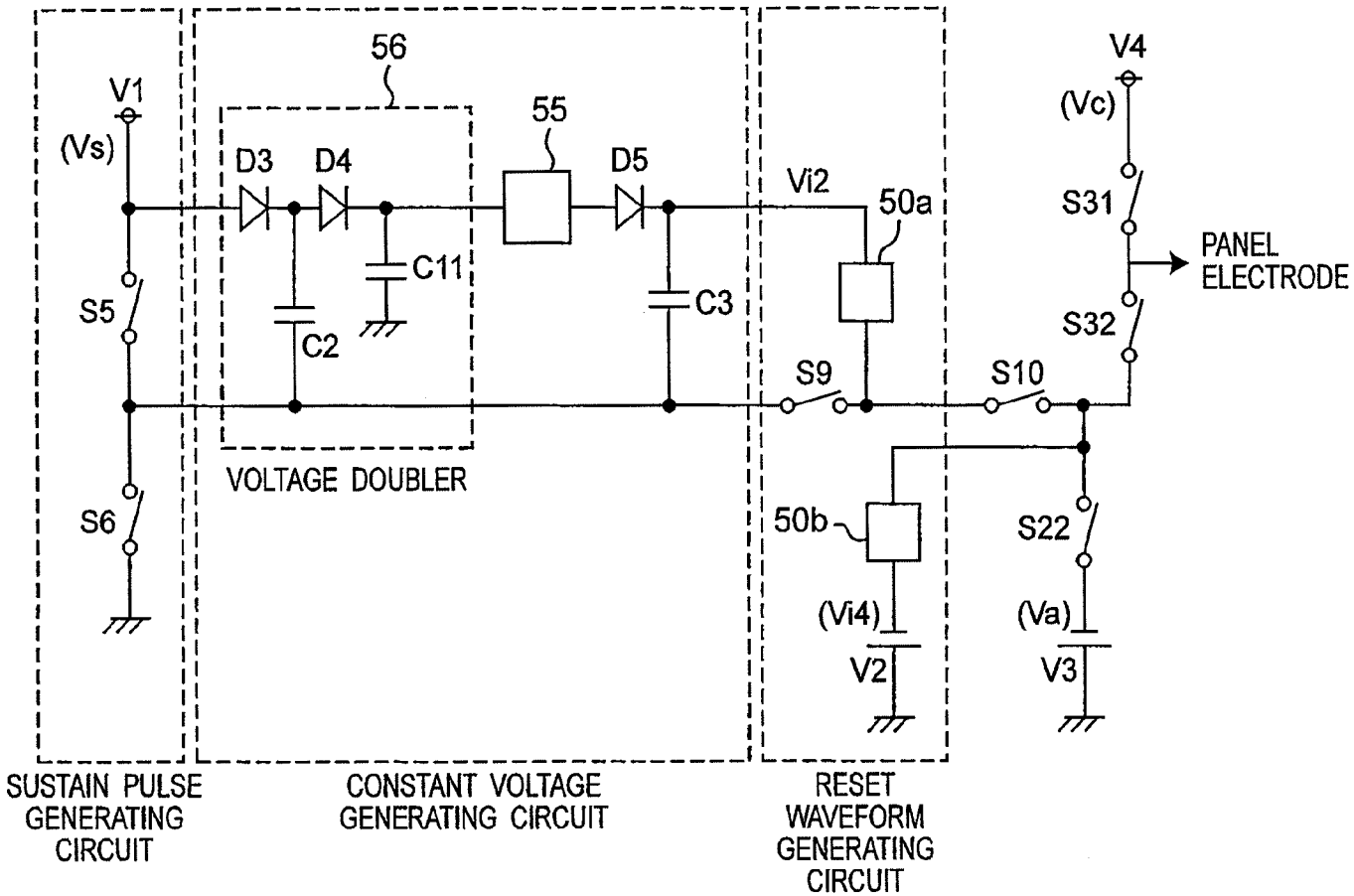
FIG. 8 is a circuit diagram showing a driving circuit in the prior art.

According to the above embodiment, in the scan electrode driving circuit 5, one of the input terminals of the voltage multiplying circuit 54 is connected to the recovery capacitor C1 with the other input terminal being connected to the constant voltage power supply V1 or the ground. This arrangement allows the voltage multiplying circuit 54 to generate the voltage 2.5 Vs (=Vs/2+2×Vs). However, it is not necessary to connect one of the input terminals of the voltage multiplying circuit 54 to the recovery capacitor C1. For example, as shown in FIG. 6, this may be connected to the power supply 5 that outputs a predetermined voltage Vx. At this time, the voltage Vx may be set to a voltage to satisfy 0<Vx<Vs. The power supply V5 can be realized, for example, by setting a tap at a middle position of the secondary coil of a transformer that outputs the voltage Vs. By appropriately setting the tap position, a desired voltage Vx can be obtained from the tap. Alternatively, power supplies V2, V3 and V4 may be utilized as the power supply V5. Alternatively, a power supply that generates a gate voltage for driving the switching elements may be used as the power supply V5.

In general, the voltage multiplying circuit 54 may be designed so that a predetermined voltage Vx is inputted to one of its input terminals and a predetermined voltage Vy or 0 is inputted to the other terminal. Here, the voltage Vx is determined as such a value as to satisfy $0<Vx<Vy$. With this arrangement, the voltage multiplying circuit 54 can generate a voltage that satisfies $(Vx+n\times Vy)$ (n=1, 2, 3, . . . ) so that it becomes possible to generate a voltage that is obtained by decimal-number-multiplying Vy only using the voltage multiplying circuit without use of a regulator.

Moreover, the switching element S9 for separating the constant voltage power supply V1 may be provided in the sustain pulse generating circuit 51 (in the same manner in the structure of FIG. 5).

INDUSTRIAL APPLICABILITY

According to the PDP driving circuit and the plasma display apparatus of the present invention, since a voltage provided by decimal-number-multiplying a predetermined voltage can be generated, and it is possible to generate a voltage required for driving without use of a regulator, and consequently to reduce the number of elements composing the driving circuit. Thus, the present invention is useful to a driving circuit for a plasma display panel and/or a plasma display apparatus.

Although the present invention has been described in connection with specified embodiments thereof, many other modifications, corrections and applications are apparent to those skilled in the art. Therefore, the present invention is not limited by the disclosure provided herein but limited only to the scope of the appended claims. The present disclosure relates to subject matter contained in Japanese Patent Application No. 2006-028063, filed on Feb. 6, 2006, which is expressly incorporated herein by reference in its entirety.

What is claimed is:

1. A plasma display panel driving circuit for driving a plasma display panel which has a plurality of scan electrodes and sustain electrodes and operates as a capacitive load, by applying a different waveform in each of a reset period, address period and sustain period, comprising:

a voltage multiplying circuit having a first input terminal to which 0 or a first voltage is inputted and a second input terminal to which a second voltage that is smaller than the first voltage is inputted, wherein the voltage multiplying circuit is operable to generate a voltage prepared by adding the second voltage to a voltage equivalent to and integral multiple of the first voltage.

2. The plasma display panel driving circuit according to claim 1, further comprising a sustain pulse generating circuit which is a circuit including a dc power supply and generating a voltage waveform to be applied to the scan electrodes during the sustain period based upon the output voltage of the dc power supply, the sustain pulse generating circuit further including a power recovery section that recovers power accumulated in the capacitive load into a recovery capacitor by LC resonance and reuses the recovered power for driving the scan electrode, wherein the second input terminal of the voltage multiplying circuit is connected to one end of the recovery capacitor.

3. The plasma display panel driving circuit according to claim 1, further comprising a reset waveform generating circuit that generates a reset waveform to be applied to the scan electrode during the reset period, wherein the voltage generated by the voltage multiplying circuit is applied to the reset waveform generating circuit.

4. The plasma display panel driving circuit according to claim 1, wherein the voltage multiplying circuit includes:

a first diode having an anode connected to the recovery capacitor;

a second diode having an anode connected to the cathode of the first diode;

a first pump-up capacitor having one end connected to the cathode of the first diode, and the other end to which either one of a predetermined voltage and the grounding potential can be selectively applied;

a charging capacitor having one end connected to the cathode of the second diode, and the other end connected to the grounding potential;

a third diode having an anode connected to the cathode of the second diode; and a second pump-up capacitor having one end connected to the cathode of the third diode and the other end to which either one of a predetermined voltage and the grounding potential can be selectively applied.

5. A plasma display apparatus comprising:

a plasma display panel; and the plasma display panel driving circuit according to claim 1 which drives the plasma display panel.

6. The plasma display apparatus according to claim 5, wherein the plasma display panel driving circuit further comprises a sustain pulse generating circuit which is a circuit including a dc power supply and generating a voltage waveform to be applied to the scan electrode during the sustain period based upon the output voltage of the dc power supply, the sustain pulse generating circuit further includes a power recovery section that recovers power accumulated in the capacitive load into a recovery capacitor by LC resonance and reuses the recovered power for driving the scan electrode, and the second input terminal of the voltage multiplying circuit is connected to one end of the recovery capacitor.

7. The plasma display apparatus according to claim 5, wherein the plasma display panel driving circuit further comprises a reset waveform generating circuit that generates a reset waveform to be applied to the scan electrode during the reset period, wherein the voltage generated by the voltage multiplying circuit is applied to the reset waveform generating circuit.

8. The plasma display apparatus according to claim 5, wherein the voltage multiplying circuit includes:

a first diode having an anode connected to the recovery capacitor;

a second diode having an anode connected to the cathode of the first diode;

a first pump-up capacitor having one end connected to the cathode of the first diode, and the other end to which either one of a predetermined voltage and the grounding potential can be selectively applied;

a charging capacitor having one end connected to the cathode of the second diode, and the other end connected to the grounding potential;

a third diode having an anode connected to the cathode of the second diode; and a second pump-up capacitor having one end connected to the cathode of the third diode and the other end to which either one of a predetermined voltage and the grounding potential can be selectively applied.

* * * * *